US009488939B1

(12) United States Patent
Onishi

(10) Patent No.: US 9,488,939 B1
(45) Date of Patent: Nov. 8, 2016

(54) FIXING DEVICE INCLUDING A BLOWING MEMBER FOR BLOWING AIR AND IMAGE FORMING APPARATUS THEREWITH

(71) Applicant: KYOCERA Document Solutions Inc., Osaka (JP)

(72) Inventor: Yuzo Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/076,015

(22) Filed: Mar. 21, 2016

(30) Foreign Application Priority Data

Apr. 27, 2015 (JP) ..... 2015-090060

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
USPC ..... 399/322
See application file for complete search history.

(56) References Cited

U.S. PATENT DOCUMENTS 8,755,733 B2 * 6/2014 Ehara et al. ..... G03G 15/2028 399/322

FOREIGN PATENT DOCUMENTS

JP 2002-132078 A 5/2002

* cited by examiner

*Primary Examiner* — William J Royer
(74) *Attorney, Agent, or Firm* — Stein IP, LLC

(57) ABSTRACT

A fixing device has a fixing member, a guide member, and a blowing member. The guide member is pivotable to be located selectively either in a first position where it guides a recording medium to a fixing nip and a second position where it shuts a recording medium transport passage. When the fixing member is driven to rotate, the guide member is located in the first position to guide air blown from the blowing member to opposite ends of the fixing member. When the fixing member is not driven to rotate, the guide member is located in the second position to let air blown from the blowing member pass between the guide member and the fixing member.

7 Claims, 5 Drawing Sheets

FIXING DEVICE INCLUDING A BLOWING MEMBER FOR BLOWING AIR AND IMAGE FORMING APPARATUS THEREWITH

INCORPORATION BY REFERENCE

The present application is based on, and claims priority from, Japanese Patent Application No. 2015-090060, filed on Apr. 27, 2015, the disclosure of which is hereby incorporated by reference herein in its entirety.

BACKGROUND

The present disclosure relates to a fixing device, and to an image forming apparatus incorporating a fixing device. More particularly, the present disclosure relates to a fixing device including a blowing member for blowing air, and to an image forming apparatus incorporating such a fixing device.

In image forming apparatuses, for the purpose of fixing a toner image to a sheet (recording medium), there are widely used fixing devices that include a fixing member composed of a heating roller (heating rotary member) and a pressing roller (pressing rotary member) held in pressed contact. In such a fixing device, the sheet is passed through a fixing nip formed between the heating and pressing rollers so that the toner image is subjected to heat and pressure; the toner image is thus fused and fixed to the sheet.

However, when small sheets are handled for fixing, whereas a sheet-passage region on the surface of the fixing member where a sheet passes loses heat to the sheet and becomes cold, a non-sheet-passage region where the sheet does not pass remains hot. In particular, when sheets are passed continuously, keeping the sheet-passage region on the fixing member at a fixing temperature may cause the non-sheet-passage region on the fixing member to overheat. Inconveniently, the fixing member and other components may then be exposed to temperature higher than their heatproof temperature and thermally break down.

As a solution, there are known fixing devices that include a blowing member which blows air toward opposite end parts of a fixing roller (heating roller). With such a fixing device, even when small sheets are passed continuously, the non-sheet-passage region (opposite end parts of the fixing roller) is prevented from overheating by the air that is blown to the opposite end parts of the fixing roller.

SUMMARY

According to one aspect of the present disclosure, a fixing device includes a fixing member, a guide member, and a blowing member. The fixing member has a heating rotary member and a pressing rotary member, with the latter in pressed contact with the former, and heats and presses a toner image carried on a recording medium to fix the toner image to the recording medium. The guide member is arranged on the upstream side of the fixing member with respect to the recording medium transport direction, and guides the recording medium to a fixing nip formed between the heating rotary member and the pressing rotary member. The blowing member blows air in a direction intersecting the recording medium transport direction. The guide member is pivotable about a predetermined pivot axis so as to be located selectively either in a first position where the guide member guides the recording medium to the fixing nip and a second position where the guide member shuts a recording medium transport passage. When the fixing member is driven to rotate, the guide member is located in the first position such that the air blown from the blowing member has the blowing direction thereof changed by the guide member so as to be directed to at least opposite end parts of the fixing member in the width direction of the recording medium which is perpendicular to the rotation direction of the fixing member. When the fixing member is not driven to rotate, the guide member is located in the second position such that the air blown from the blowing member passes between the guide member and the fixing member.

Other objects of, and specific benefits resulting from, the present disclosure will become clear with reference to the following description of embodiments thereof.

DETAILED DESCRIPTION

Embodiments of the present disclosure will be described below with reference to the accompanying drawings.

First Embodiment

With reference to FIGS. 1 to 5, a description will be given of an image forming apparatus 100 incorporating a fixing device 13 according to a first embodiment of the present disclosure.

In the first embodiment, the image forming apparatus 100 (here, a color printer) is a four-stage tandem-type color printer that performs image formation by using four photosensitive drums (image carriers), corresponding to four different colors (yellow, cyan, magenta, and black) respectively, arranged side by side.

Figure 1:
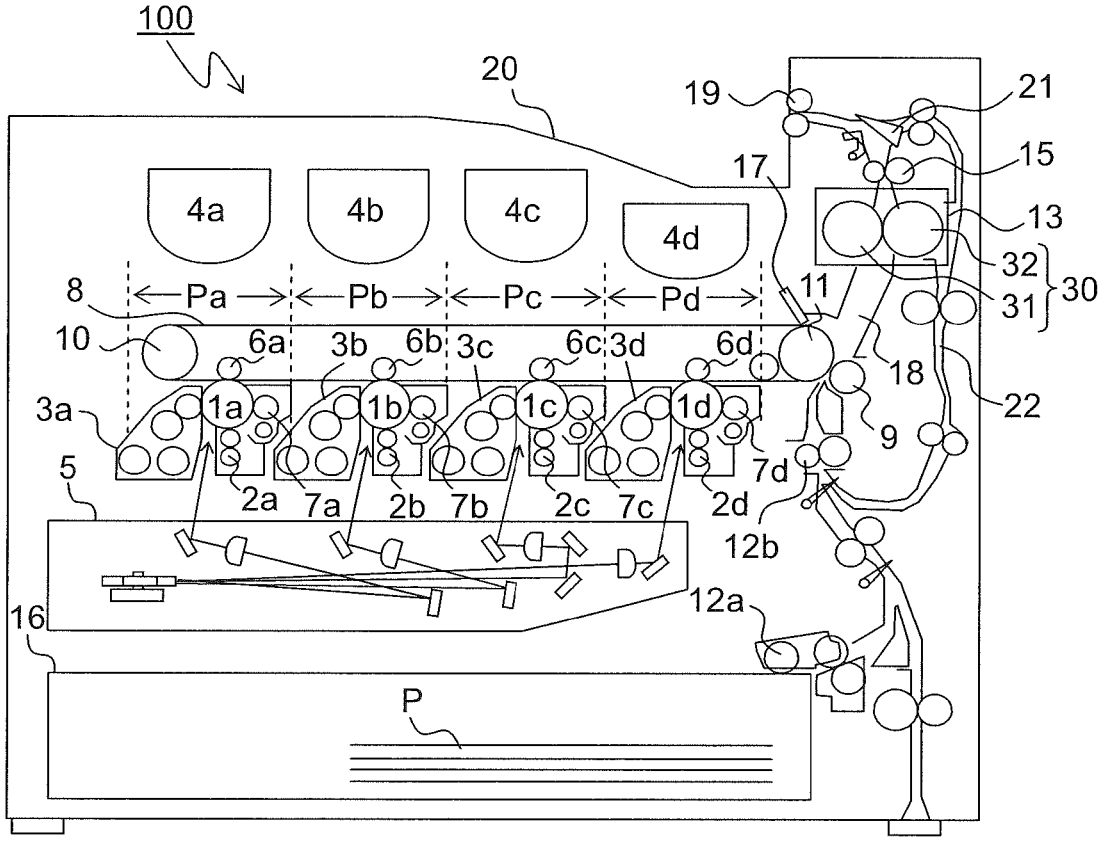
FIG. 1 is a sectional view schematically showing a construction of an image forming apparatus incorporating a fixing device according to a first embodiment of the present disclosure.

Inside the apparatus body of the image forming apparatus 100, four image forming sections Pa, Pb, Pc, and Pd are arranged in this order from left to right as seen in FIG. 1. These image forming sections Pa to Pd are provided to correspond to images of four different colors (yellow, cyan, magenta, and black), and form a yellow, a cyan, a magenta, and a black image sequentially, each through the processes of electrostatic charging, exposure to light, image development, and image transfer.

The image forming sections Pa to Pd respectively include photosensitive drums 1*a* to 1*d* for carrying visible images (toner images) of the different colors, and a transfer belt 8 which rotates counter-clockwise as seen in FIG. 1 is provided next to the image forming sections Pa to Pd. The toner images formed on these photosensitive drums 1*a* to 1*d* are sequentially transferred to the transfer belt 8, which moves while in contact with the photosensitive drums 1*a* to 1*d*, are then simultaneously transferred to a sheet P of paper, as one example of a recording medium, at a secondary transfer roller 9, and are then fixed to the sheet P in a fixing device 13. The sheet P is then discharged out of the apparatus body. While the photosensitive drums 1*a* to 1*d* are rotated clockwise as seen in FIG. 1, the processes for image formation are performed with respect to each of the photosensitive drums 1*a* to 1*d*.

Sheets P, to which toner images are to be transferred, are stored in a sheet cassette 16 in a lower part of the image forming apparatus 100, and are transported to the secondary transfer roller 9 via a sheet feed roller 12*a* and a registration roller pair 12*b*. Used as the transfer belt 8 is a sheet of a dielectric resin, and it typically is a belt with no seam (a seamless belt). The transfer belt 8 and the secondary transfer roller 9 are driven by a belt drive motor (unillustrated) to rotate at the same linear velocity as the photosensitive drums 1*a* to 1*d*. On the downstream side of the secondary transfer roller 9, there is arranged a belt cleaner 17, in the shape of a blade, for removing toner and the like that are left behind on the surface of the transfer belt 8.

Next, the image forming sections Pa to Pd will be described. Around and under the photosensitive drums 1*a* to 1*d*, which are rotatably arranged, there are arranged charging devices 2*a*, 2*b*, 2*c*, and 2*d* for electrostatically charging the photosensitive drums 1*a* to 1*d*; an exposure unit 5 for exposing the photosensitive drums 1*a* to 1*d* to light based on image data; developing units 3*a*, 3*b*, 3*c*, and 3*d* for developing electrostatic latent images formed on the photosensitive drums 1*a* to 1*d* with toner; and cleaning devices 7*a*, 7*b*, 7*c*, and 7*d* for collecting and removing developer (toner) that is left behind on the photosensitive drums 1*a* to 1*d* after the transfer of toner images.

When image data is fed in from a host device such as a personal computer, first, the surfaces of the photosensitive drums 1*a* to 1*d* are electrostatically charged uniformly by the charging devices 2*a* to 2*d*, and then those surfaces are irradiated with light based on the image data by the exposure unit 5, so that electrostatic latent images based on the image data are formed on the photosensitive drums 1*a* to 1*d*. The developing units 3*a* to 3*d* respectively include developing rollers arranged opposite the photosensitive drums 1*a* to 1*d*, and are charged with predetermined amounts of two-component developer containing yellow, cyan, magenta, and black toner respectively.

As toner images are formed as will be described later, the proportion of toner in the two-component developer stored in the developing units 3*a* to 3*d* decreases; when it falls below a prescribed amount, the developing units 3*a* to 3*d* are replenished with toner from toner containers 4*a* to 4*d*. The toner is fed from the developing units 3*a* to 3*d* onto the photosensitive drums 1*a* to 1*d*, and electrostatically attaches to them, thereby forming toner images based on the electrostatic latent images formed by exposure to light by the exposure unit 5.

Then, by primary transfer rollers 6*a* to 6*d*, an electric field with a predetermined transfer voltage is produced between them and the photosensitive drums 1*a* to 1*d*. so that the yellow, cyan, magenta, and black toner images on the photosensitive drums 1*a* to 1*d* are primarily transferred to the transfer belt 8. These images of four colors are formed in a predetermined positional relationship that is prescribed for the formation of a predetermined full-color image. Thereafter, in preparation for the subsequent formation of new electrostatic latent images, the toner left behind on the surfaces of the photosensitive drums 1*a* to 1*d* is removed by the cleaning devices 7*a* to 7*d*.

The transfer belt 8 is wound around a driven roller 10 and a driving roller 11. As the driving roller 11 is rotated by the above-mentioned belt drive motor, the transfer belt 8 rotates counter-clockwise. As a result, a sheet P is transported from the registration roller pair 12*b* to, with a predetermined timing, the nip (secondary transfer nip) between the secondary transfer roller 9 and the transfer belt 8, the former being arranged next to the latter. At the nip, the full-color image is secondarily transferred to the sheet P. The sheet P having the toner images transferred to it is transported on to the fixing device 13.

The sheet P transported to the fixing device 13 passes through a fixing nip N (see FIG. 3) between a fixing roller pair (fixing member) 30 which is composed of a heating roller (heating rotary member) 31 and a pressing roller (pressing rotary member) 32; meanwhile, the sheet P is heated and pressed, so that the toner images are fixed to the surface of the sheet P, and thereby the predetermined full-color image is formed. The sheet P having the full-color image formed on it passes through a transport roller pair 15, and is then sorted between different transport directions by a sorting member 21 arranged in a branch part of a sheet transfer passage 18. The sheet P is thus discharged, either directly or after being passed into a two-sided copying transfer passage 22 for two-sided copying, via a discharge roller pair 19 onto a discharge tray 20.

Specifically, on the downstream side of the transport roller pair 15, the sheet transfer passage 18 branches into two, leftward and rightward, paths. One path (the one running leftward in FIG. 1) leads to the discharge tray 20. The other path (the one running rightward in FIG. 1) leads to the two-sided copying transfer passage 22. In a case where a sheet P is subjected to two-sided copying, part of the sheet P that has passed through the fixing device 13 is stuck out of the apparatus via the discharge roller pair 19.

Then, the discharge roller pair 19 is rotated in the reverse direction, and the sorting member 21 is swung to be substantially horizontal, so that the sheet P is guided along the top face of the sorting member 21 into the two-sided copying transfer passage 22. The sheet P is then transported, with the image face reversed, once again to the secondary transfer roller 9. Then, by the secondary transfer roller 9, the next image formed on the transfer belt 8 is transferred to the face of the sheet P on which no image has been formed yet. The sheet P is then transported to the fixing device 13, where the toner image is fixed, and is then discharged onto the discharge tray 20.

Figure 2:
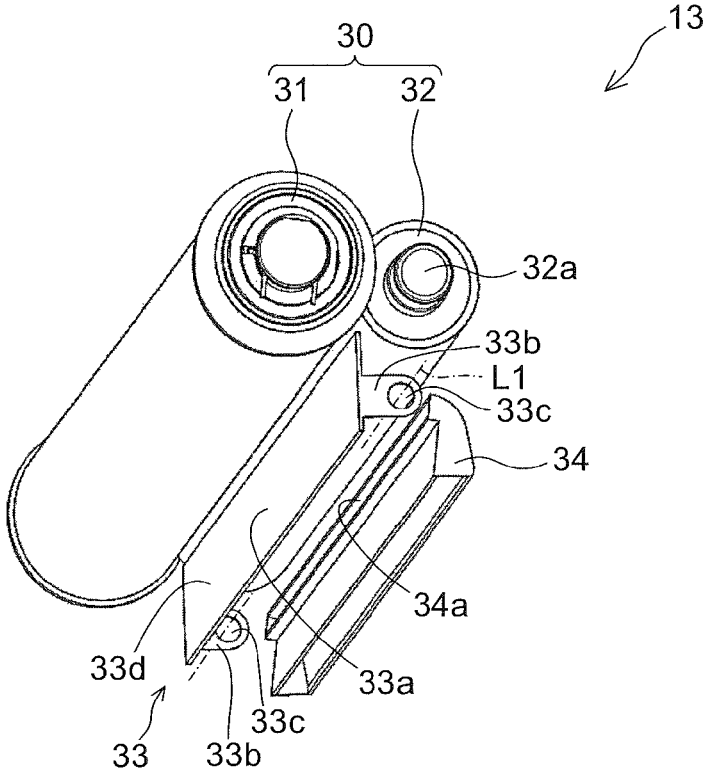
FIG. 2 is a perspective view of a fixing device according to the first embodiment of the present disclosure, as observed when fixing takes place.
Figure 3:
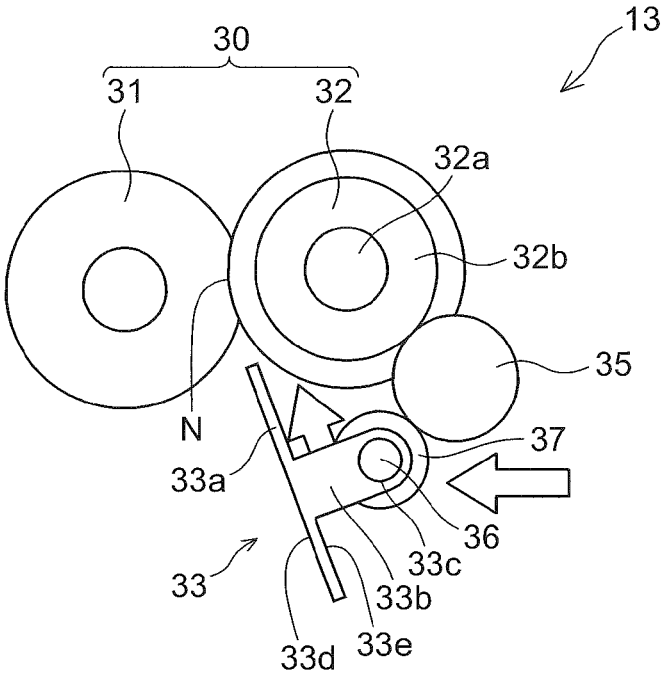
FIG. 3 is a side view of a fixing device according to the first embodiment of the present disclosure, as observed when fixing takes place.

As shown in FIGS. 2 and 3, the fixing device 13 includes a fixing roller pair (fixing member) 30, which is composed of a heating roller 31 and a pressing roller 32, a guide member 33, and a duct (blowing member) 34.

Used as the heating roller 31 is a so-called hard roller, which is a cylindrical metal core that is formed of a metal with high heat conductivity such as aluminum or iron and that is coated with a fluoropolymer with a good mold release property such as PFA (tetrafluoroethylene-perfluoroalkylvinylether copolymer), with a heat source such as an unillustrated halogen heater provided inside the metal core. Used as the pressing roller 32 is a roller that has an elastic layer such as of silicone rubber formed on a cylindrical base formed of a synthetic resin, metal, or other material, with the surface of the elastic layer coated with a resin with a good mold release property such as a fluoropolymer.

The heating roller 31 and the pressing roller 32 are arranged in pressed contact with each other and parallel to each other. The heating roller 31 and the pressing roller 32 are configured to fuse and fix toner, thus far in a powder state, by heating and pressing a sheet P that is transported to the fixing nip N between them.

Moreover, as shown in FIG. 3, the pressing roller 32 has a rotary shaft 32*a*, which is fitted with a gear 32*b*. The gear 32*b* is meshed with a drive gear 35 so as to receive via the drive gear 35 a rotation driving force from a drive motor (unillustrated).

Figure 4:
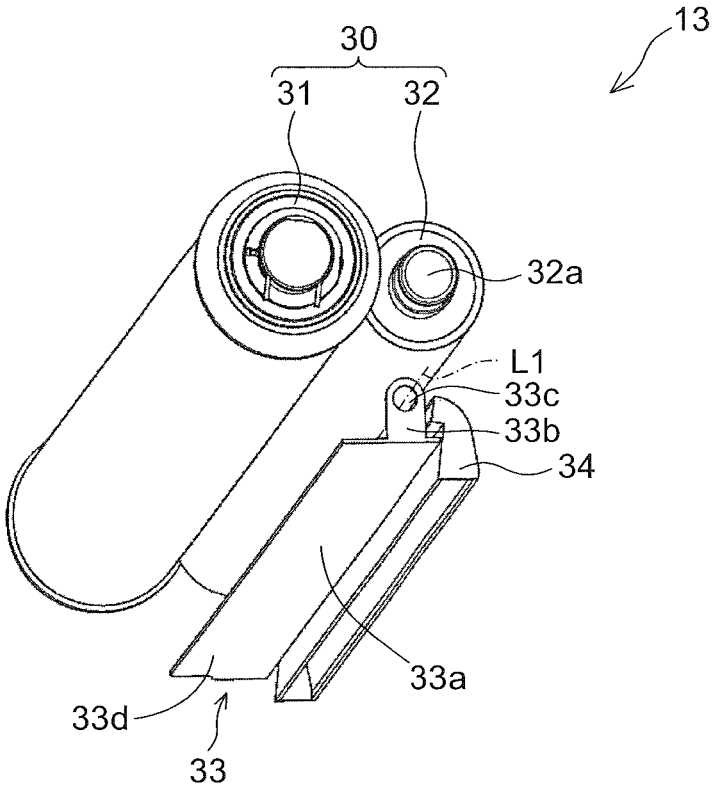
FIG. 4 is a perspective view of a fixing device according to the first embodiment of the present disclosure, as observed when fixing does not take place.

The guide member 33 is arranged on the upstream side (in FIG. 3, on the bottom side) of the fixing roller pair 30 with respect to the sheet transport direction, and is configured to guide a sheet P to the fixing nip N. As shown in FIGS. 2 and 4, the guide member 33 can pivot about a pivot axis L1 (through the center of a shaft 36, which will be described later) so as to be located selectively either in a first position (shown in FIGS. 2 and 3) in which the guide member 33 guides a sheet P to the fixing nip N or in a second position (shown in FIGS. 4 and 5) in which the guide member 33 shuts the sheet transfer passage 18 (and does not guide a sheet P to the fixing nip N).

Specifically, the guide member 33 includes a plate 33*a* and a support 33*b*, the support 33*b* being formed at either end of the plate 33*a* in the axial direction of the fixing roller pair 30 (which is the sheet width direction and is perpendicular to the rotation direction). The support 33*b* has a through hole 33*c* formed in it, in which a shaft 36 (see FIG. 3) is press-fitted. The shaft 36 is fitted with a transmission gear 37 (see FIG. 3), which is meshed with the drive gear 35. The shaft 36 and the transmission gear 37 constitute a pivoting member which makes the guide member 33 pivot.

When the fixing roller pair 30 is driven to rotate (when fixing takes place), the drive gear 35 rotates in the counterclockwise direction as seen in FIG. 3 to transmit a rotation driving force to the fixing roller pair 30, and thus the transmission gear 37 and the shaft 36 rotate in the clockwise direction. As a result, the guide member 33 pivots from the second position to the first position. In the first position, the guide member 33 abuts on a regulating member (unillustrated), and is held in the first position by the action of a torque limiter incorporated in the transmission gear 37. When the fixing roller pair 30 ceases to be driven to rotate (when fixing ceases to take place), the guide member 33 returns from the first position to the second position by pivoting under its own weight.

With the guide member 33 in the first position, a face (guide face 33*d*) of the guide member 33 opposite from the duct 34 (in FIG. 3, a left face) guides a sheet P, and a face (blowing face 33*e*) of the guide member 33 facing the duct 34 (in FIG. 3, a right face) changes the direction of the air that is blown from the duct 34.

The duct 34 is provided so as to blow air to an upstream side (in FIG. 2, the bottom side) of the fixing roller pair 30 with respect to the sheet transport direction, in a direction (leftward) intersecting the sheet transport direction. On the upstream side of the duct 34 with respect to the blowing direction, an unillustrated blower (fan) is provided. The blower is configured to blow air constantly when the heat source in the heating roller 31 is generating heat. Thus, both when the fixing roller pair 30 is being driven to rotate (when fixing is taking place) and when the fixing roller pair 30 is not being driven to rotate (when fixing is not taking place), air keeps being blown from the duct 34 through a discharge port 34*a* thereof (see FIG. 2).

In the first embodiment, there are provided one discharge port 34*a* of the duct 34 and one guide member 33, and these are each configured to extend in the axial direction of the fixing roller pair 30 from a position facing one end part thereof to a position facing an opposite part thereof.

In the fixing device 13, when the fixing roller pair 30 is driven to rotate (when fixing takes place), as shown in FIGS. 2 and 3, the guide member 33 is located in the first position. Thus the air blown from the duct 34 has its blowing direction (passing direction) changed by the blowing face 33*e* of the guide member 33 so as to be guided to the entire fixing roller pair 30 in its axial direction. Meanwhile, the guide face 33*d* of the guide member 33 guides a sheet P to the fixing nip N.

Figure 5:
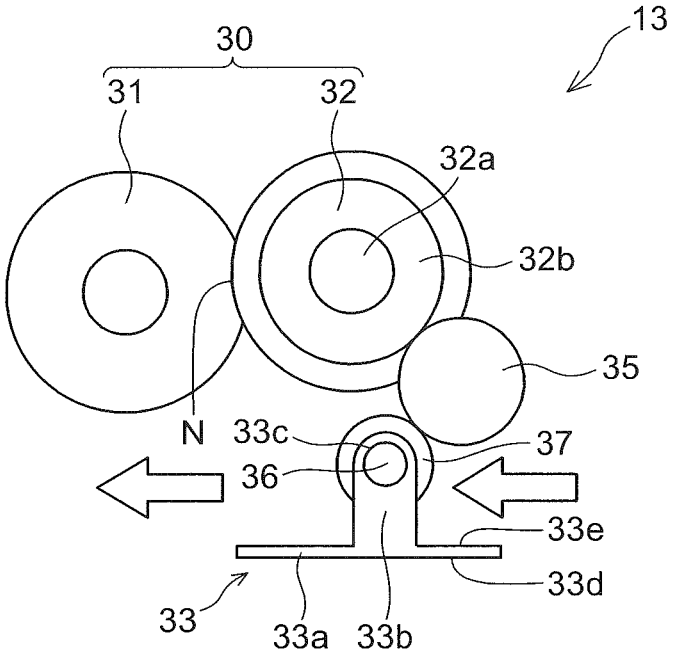
FIG. 5 is a side view of a fixing device according to the first embodiment of the present disclosure, as observed when fixing does not take place.

On the other hand, when the fixing roller pair 30 is not driven to rotate (when fixing does not take place), as shown in FIGS. 4 and 5, the guide member 33 is located in the second position. Thus, the air blown from the duct 34 passes between the guide member 33 and the fixing roller pair 30.

In the first embodiment, as described above, when the fixing roller pair 30 is driven to rotate, the guide member 33 is located in the first position, and the air blown from the duct 34 has its blowing direction (passing direction) changed by the guide member 33 so as to be directed to the entire fixing roller pair 30 in its axial direction. Thus, it is possible, even when small sheets are passed continuously, to suppress overheating of opposite end parts of the fixing roller pair 30.

On the other hand, when the fixing roller pair 30 is not driven to rotate, the guide member 33 is located in the second position, and the air blown from the duct 34 passes between the guide member 33 and the fixing roller pair 30. It is thus possible to suppress air that is blown to the fixing roller pair 30 when the fixing roller pair 30 is not driven to rotate, and thus to suppress a fall in the temperature of the fixing roller pair 30. This eliminates the need to keep the fixing roller pair 30 at a predetermined temperature by heating it more than is necessary, and it is thus possible to suppress an increase in power consumption.

Moreover, as a result of the air blown from the duct 34 passing between the guide member 33 and the fixing roller pair 30, the air functions as an air curtain. Thus, it is possible to suppress conduction of the heat generated in the fixing device 13 to other process units (e.g., developing units 3*a* to 3*d*). It is thus possible to suppress an adverse effect of the heat of the fixing device 13 on toner and the like.

Moreover, as described above, the pivoting member (the shaft 36 and the transmission gear 37) for making the guide member 33 pivot is coupled to the drive gear 35. This makes it easy to make the guide member 33 pivot in a coordinated fashion as the fixing roller pair 30 is driven to rotate. In addition, there is no need to provide a separate driving source for making the guide member 33 pivot.

Moreover, as described above, the discharge port 34*a* of the duct 34 and the guide member 33 are each formed so as to extend in the axial direction of the fixing roller pair 30 from a position facing one end part thereof to a position facing an opposite part thereof. This helps suppress complexity in the structure of the duct 34 and of the guide member 33. In addition, when the fixing roller pair 30 is not driven to rotate, it is possible to form an air curtain that extends from one end part to an opposite end part of the fixing roller pair 30, and thus to sufficiently suppress conduction of the heat generated in the fixing device 13 to other process units.

Moreover, as described above, with the guide member 33 located in the first position, the face (guide face 33*d*) of the guide member 33 opposite from the duct 34 guides a sheet P. That is, the sheet P passes on the opposite side of the guide member 33 from the duct 34. Thus, it is possible to suppress an adverse effect on sheet transport of the air from the duct 34 striking the sheet P.

Second Embodiment

Figure 6:
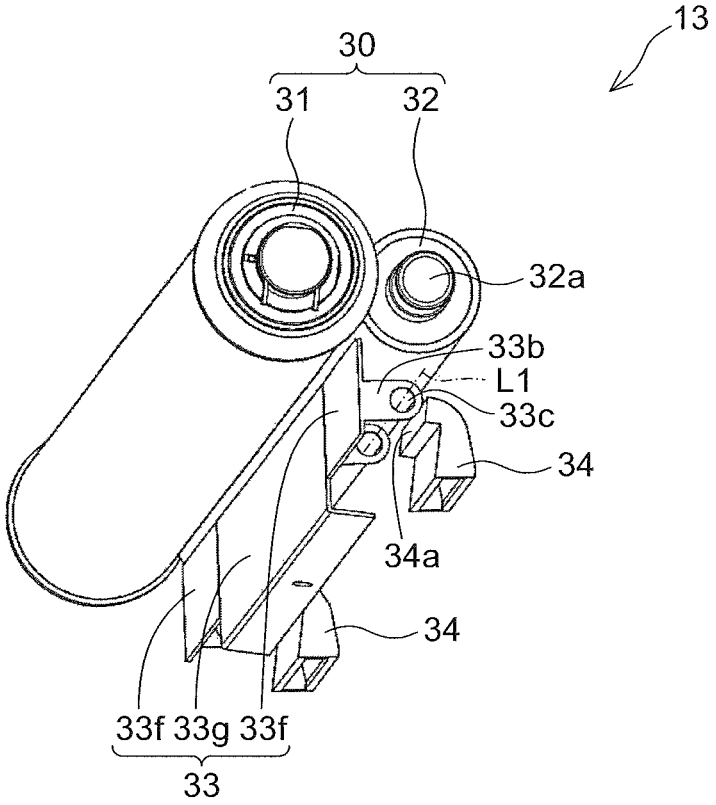
FIG. 6 is a perspective view of a fixing device according to a second embodiment of the present disclosure, as observed when fixing takes place.

In a second embodiment of the present disclosure, as shown in FIG. 6, the discharge port 34*a* of the duct 34 is divided in the axial direction of the fixing roller pair 30 to correspond to opposite end parts of the fixing roller pair 30. Although in FIG. 6 the duct 34 is shown to be divided, it is not divided in an upstream part thereof with respect to the blowing direction, and there is provided only one blower (unillustrated).

Figure 7:
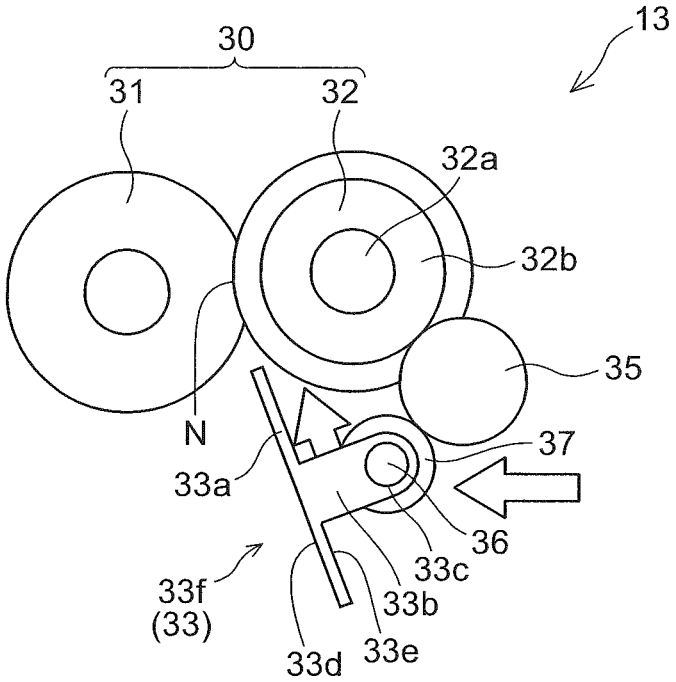
FIG. 7 is a side view of a fixing device according to the second embodiment of the present disclosure, as observed when fixing takes place.

As shown in FIGS. 6 and 7, the guide member 33 is divided in the axial direction of the fixing roller pair 30. Specifically, the guide member 33 comprises a pair of outer guide members 33*f* arranged to face opposite end parts of the fixing roller pair 30 and an inner guide member 33*g* arranged between the pair of outer guide members 33*f*.

The inner guide member 33*g* is fixed in a first position (the position shown in FIGS. 6 and 7) in which it guides a sheet P to the fixing nip N. The pair of outer guide members 33*f* can, as in the first embodiment described previously, pivot about a pivot axis L1 (through the center of a shaft 36) so as to be located selective either in a first position (the position shown in FIGS. 6 and 7) in which the outer guide members 33*f* guide a sheet P to the fixing nip N or in a second position (the position shown in FIGS. 8 and 9) in which the outer guide members 33*f* shut the sheet transfer passage 18.

In this fixing device 13, when the fixing roller pair 30 is driven to rotate (when fixing takes place), as shown in FIGS. 6 and 7, the pair of outer guide members 33*f* and the inner guide member 33*g* are located in the first position. Thus, the air blown from the duct 34 has its blow direction (passing direction) changed by the blowing face 33*e* of the guide member 33 so as to be directed to opposite end parts of the fixing roller pair 30 in its axial direction.

Figure 8:
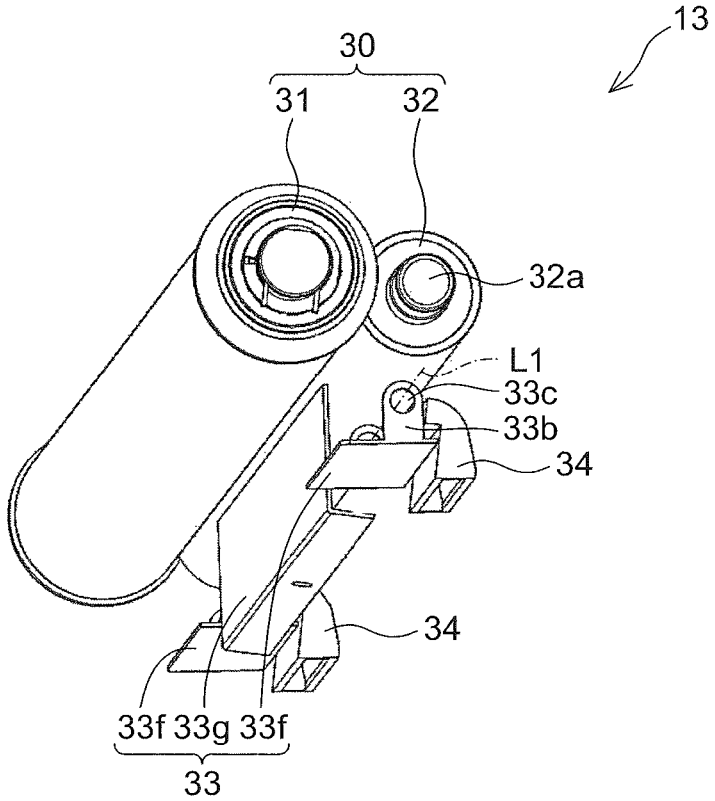
FIG. 8 is a perspective view of a fixing device according to a second embodiment of the present disclosure, as observed when fixing does not take place.
Figure 9:
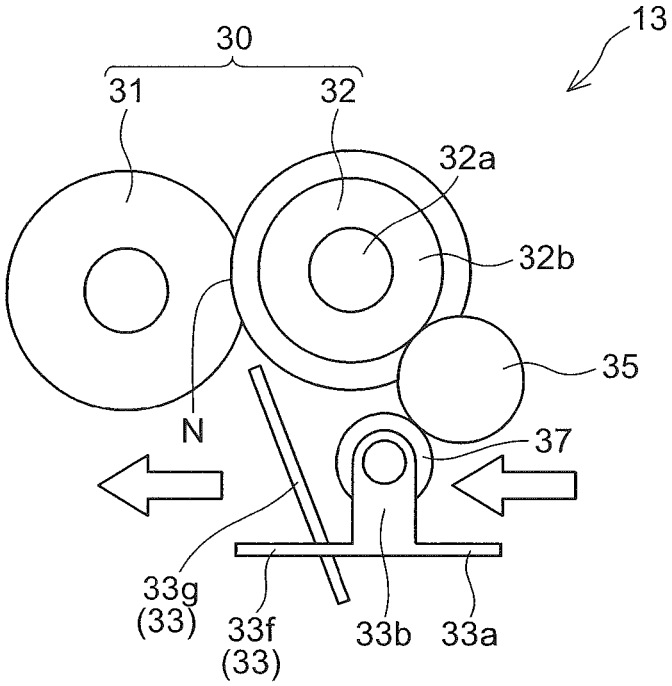
FIG. 9 is a side view of a fixing device according to the second embodiment of the present disclosure, as observed when fixing does not take place.

On the other hand, when the fixing roller pair 30 is not driven to rotate (when fixing does not take place), as shown in FIGS. 8 and 9, whereas the inner guide member 33*g* is located in the first position, the pair of outer guide members 33*f* is located in the second position. Thus, the air blown from the duct 34 passes between the pair of outer guide members 33*f* and the fixing roller pair 30.

In other respects, the second embodiment is configured similarly to the first embodiment described previously.

In the second embodiment, as described above, the discharge port 34*a* of the duct 34 is divided to correspond to opposite end parts of the fixing roller pair 30, and the guide member 33 comprises a pair of outer guide members 33*f* arranged to correspond to opposite end parts of the fixing roller pair 30 and an inner guide member 33*g* arranged between the pair of outer guide members 33*f*. When the fixing roller pair 30 is driven to rotate, the pair of outer guide members 33*f* and the inner guide member 33*g* are located in the first position, and when the fixing roller pair 30 is not driven to rotate, whereas the inner guide member 33*g* is located in the first position, the pair of outer guide members 33*f* is located in the second position. In this way, it is possible to suppress air that is blown to a middle part of the fixing roller pair 30 when the fixing roller pair 30 is driven to rotate. It is also possible to reduce the area of the discharge port 34*a* of the duct 34, and thus to obtain necessary wind speed even with a reduced air output from the blower. It is thus possible to make the blower compact, and to suppress electric power consumption.

In other respects, the second embodiment provides similar benefits to the first embodiment described previously.

It is to be understood that the embodiments disclosed herein are in every aspect only illustrative and not restrictive. The scope of the present disclosure is defined not by the description of embodiments given above but by the appended claims, and encompasses any modification made in the sense and scope equivalent to those of the appended claims.

For example, although the above description deals with examples where the present disclosure is applied to a color printer, this is not meant to limit the application of the present disclosure. Needless to say, the present disclosure finds applications in various image forming apparatuses provided with a fixing device including a guide member and a blowing member, such as monochrome printers, color copiers, monochrome copiers, digital multifunction peripherals, and facsimile machines.

Although the embodiments described above deal with examples where a duct 34 is provided as a blowing member and a blower is provided on the upstream side of the duct 34 with respect to the blowing direction, this is not meant to limit the present disclosure. For example, instead of a duct 34, a blower as a blowing member may be provided in the fixing device 13.

Although the embodiments described above deal with examples where a heating roller 31 and the pressing roller 32 are used as a heating rotary member and a pressing rotary member respectively, instead of rollers, belts (a heating belt and a pressing belt) may be used as a heating rotary member and a pressing rotary member.

What is claimed is:

1. A fixing device, comprising:

a fixing member having a heating rotary member and a pressing rotary member, the pressing rotary member being in pressed contact with the heating rotary member, the fixing member heating and pressing a toner image carried on a recording medium to fix the toner image to the recording medium;

a guide member arranged on an upstream side of the fixing member with respect to a recording medium transport direction, the guide member guiding the recording medium to a fixing nip formed between the heating rotary member and the pressing rotary member; and a blowing member for blowing air in a direction intersecting the recording medium transport direction, wherein the guide member is pivotable about a predetermined pivot axis so as to be located selectively either in a first position where the guide member guides the recording medium to the fixing nip and a second position where the guide member shuts a recording medium transport passage, when the fixing member is driven to rotate, the guide member is located in the first position such that the air blown from the blowing member has a blowing direction thereof changed by the guide member so as to be directed to at least opposite end parts of the fixing member in a width direction of the recording medium which is perpendicular to a rotation direction of the fixing member, and when the fixing member is not driven to rotate, the guide member is located in the second position such that the air blown from the blowing member passes between the guide member and the fixing member.

2. The fixing device of claim 1, further comprising:

a drive gear for driving the fixing member to rotate; and a pivoting member for making the guide member pivot, wherein the pivoting member is coupled to the drive gear.

3. The fixing device of claim 1, wherein the blowing member includes a duct having a discharge port through which the air is discharged.

4. The fixing device of claim 3, wherein the discharge port of the duct and the guide member are each formed to extend in the width direction from a position facing one end part of the fixing member to a position facing an opposite part of the fixing member.

5. The fixing device of claim 3, wherein the discharge port of the duct is divided in the width direction to correspond to the opposite end parts of the fixing member, the guide member is divided in the width direction to include a pair of outer guide members arranged to correspond to the opposite end parts of the fixing member and an inner guide member arranged between the pair of outer guide members, when the fixing member is driven to rotate, the pair of outer guide members and the inner guide member are located in the first position, and when the fixing member is not driven to rotate, whereas the inner guide member is located in the first position, the pair of outer guide members is located in the second position.

6. The fixing device of claim 1, wherein when the fixing member is driven to rotate and the guide member is located in the first position, a face of the guide member opposite from the blowing member guides the recording medium.

7. An image forming apparatus, comprising the fixing device of claim 1.

* * * * *